United States Patent [19]

Haag

[11] 4,423,783

[45] Jan. 3, 1984

[54] METHOD FOR PLUGGING A WELL AND BRIDGE PLUG

[75] Inventor: James W. Haag, Marrero, La.

[73] Assignee: Texaco Inc., White Plains, N.Y.

[21] Appl. No.: 371,170

[22] Filed: Apr. 23, 1982

[51] Int. Cl.[3] ..... E21B 33/134

[52] U.S. Cl. ..... 166/382; 166/120; 166/134

[58] Field of Search ..... 166/382, 120, 134, 135, 166/136, 179, 212, 214, 285, 286

[56] References Cited

U.S. PATENT DOCUMENTS

| | | | |
|---|---|---|---|
| 536,537 | 3/1895 | Moehn | 166/13 X |
| 2,490,350 | 12/1949 | Grable | 166/212 |
| 2,618,344 | 11/1952 | Turechek et al. | 166/13 |
| 2,710,065 | 6/1955 | Hamilton, Jr. | 166/192 |
| 3,070,163 | 12/1962 | Colby et al. | 166/295 |
| 3,208,525 | 9/1965 | Caldwell et al. | 166/295 |
| 3,437,137 | 4/1969 | Scott | 166/153 |
| 3,460,625 | 8/1969 | Hart et al. | 166/285 |
| 3,489,216 | 1/1970 | Armstrong et al. | 166/135 |
| 3,706,342 | 12/1972 | Wooley | 166/134 |
| 3,872,925 | 3/1975 | Owen et al. | 166/135 X |

*Primary Examiner*—Ernest R. Purser
*Assistant Examiner*—Thuy M. Bui
*Attorney, Agent, or Firm*—Carl G. Ries; Robert A. Kulason; Henry C. Dearborn

[57] ABSTRACT

A method for plugging a well comprises (1) extending two sets of dogs on a bridge plug for engaging the sides of the well by releasing an expandable means, and (2) releasing a high pressure fluid for triggering and releasing the expandable means for extending the two sets of dogs for securing the bridge plug at the desired depth in the well. A bridge plug for carrying out the method is also disclosed.

6 Claims, 3 Drawing Figures

METHOD FOR PLUGGING A WELL AND BRIDGE PLUG

BACKGROUND OF THE INVENTION

This invention pertains to new and useful improvements in well packers and more particularly toibridge plugs and tools for setting bridge plugs, or the like, in well bore holes.

For closing or sealing off lower portions of a well bore hole, bridge plugs are usually used. Such bridging or plugging operations are often employed, for example, when a lower zone in the well has ceased to be productive, or where the bore hole has been drilled into water-producing measures or thief sands, or for any other such reason it is desired to plug back or close-off a lower zone and produce from a higher zone in the well. In such bridging operations it is usual practice first to position a bridge plug in the well bore hole at a point adjacent the top of the zone to be sealed off, and then to place a suitable quantity of cement on top of the plug. However, heretofore, with the bridge plugs employed for this purpose, difficulties have been encountered in adequately anchoring a plug in the bore hole and securely maintaining the plug in the desired position during the cementing operation. If care were not exercised, the plug was often driven down by the weight of the cement placed on top of it. Sometimes the formation pressure below the bridge plug rose sufficiently to force the plug upward and thus displace the plug in the well bore hole from its proper setting position. In the cementing operations heretofore employed in connection with the conventional type of bridge plugs, channeling through the cement placed in or on the bridge plug often occurred, caused by the production of fluid at the point of plugging or therebelow. Furthermore, with the conventional bridging operations heretofore employed, it was necessary to lower the bridge plug upon pipe or tubing, and finally to place the cement on the bridge plug also through tubing.

Accordingly, these operations employed above were difficult, time-consuming and, for the beforementioned reasons, of uncertain effect and efficiency.

OBJECTS OF THE INVENTION

Accordingly, a primary object of this invention is to provide a method for plugging a well that will provide a fluid-tight seal and resist displacement by forces either from above or below the plug.

Another primary object of this invention is to provide a bridge plug that will form a fluid-tight seal even with an irregularly shaped or surfaced well bore hole. Thus, it is an object of this invention to provide a bridge plug which, when set in the bore hole, forms a fluid-tight seal and resists displacement by pressures either from above or below the setting point.

Accordingly, it is also an object of this invention to provide a bride plug capable of forming a fluid-tight seal with an irregularly-shaped surrounding bore hole.

Likewise, it is a further object of this invention to provide a bridge plug which will retain cement in non-channeling, sealing engagement with the walls of the surrounding bore hole.

It is a still further object of this invention to provide a bridge plug which may be rapidly lowered and positioned within the bore hole by means of a wire rope or cable which contains a conduit for the passage of first a high pressure fluid for fixing the bridge plug at the precise depth in the well, and then a higher pressure fluid, as cement, for plugging the well in an accurate, efficient, and economical manner.

A further object of this invention is to provide a mechanism and method for providing a single trip bridge plug that is easy to operate, is of simple configuration that is economical to build and assemble, and a method that is easy to implement, and is of greater efficiency for the plugging of a well even though deviated and cylindrical but irregularly shaped.

Other objects and various advantages of the disclosed methods and bridge plug will be apparent from the following detailed description, together with the accompanying drawings, submitted for purposes of illustration only and not intended to define the scope of the invention, reference being made for that purpose to the subjoined claims.

BRIEF DESCRIPTION OF THE DRAWING

The drawing diagrammatically illustrates by way of example, not by way of limitation, one form of the invention wherein like reference numerals designate corresponding parts in the several views in which.

Figure 1:
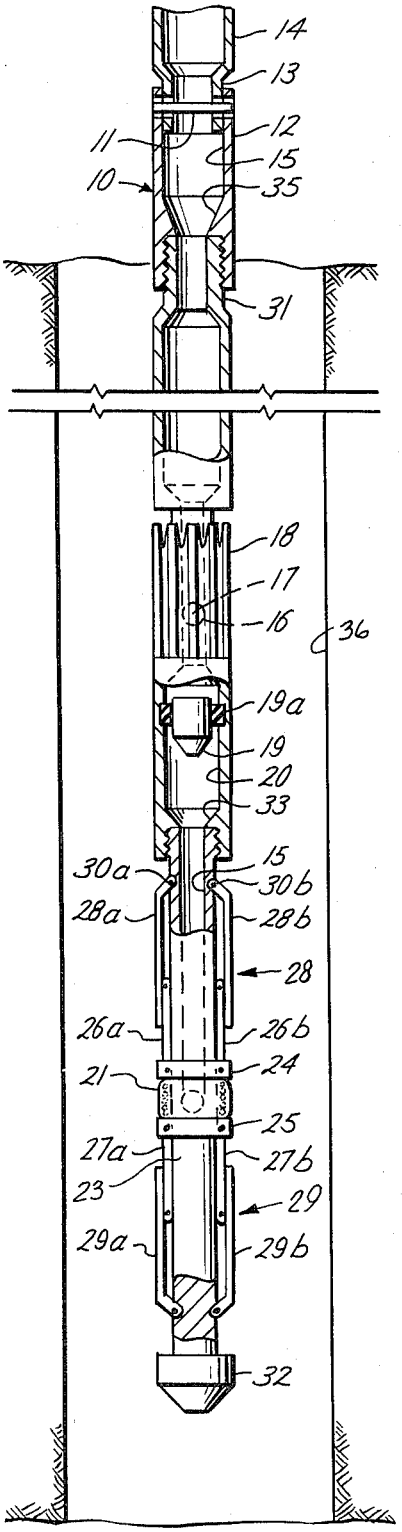
FIG. 1 is a schematic diagrammatic vertical sectional view of the new bridge plug in closed position for being lowered in a well to the desired depth

The invention disclosed herein, the scope of which being defined in the appended claims is not limited in its application to the details of construction and arrangement of parts shown and described, since the invention is capable of being in the form of other embodiments and of being practiced or carried out in various other ways. Also, it is to be understood that the phraseology or terminology employed here is for the purpose of description and not of limitation. Further, many modifications and variations of the invention as hereafter set forth may occur to those skilled in the art. Therefore, all such modifications and variations which are within the spirit and scope of the invention herein are included and only such limitations should be imposed as are indicated in the appended claims.

DESCRIPTION OF THE INVENTIONS

This patent includes two inventions, a method for plugging a well for cementing, or the like, and a mechanism for practicing the above method comprising a new and novel bridge plug for lowering in a well to the desired depth.

A basic method for plugging a well comprises, (1) extending two sets of dogs (28, 29) on a bridge plug (10) for engaging the sides of the well (36) by releasing an expandable means (22), and (2) releasing a high pressure fluid with releaseable means for triggering and releasing the expandable means for extending the two sets of dogs for securing the bridge plug at the desired depth in the well.

The first step above may be expanded to include, (1) releasing a spring (22) compressed between the two sets of oppositely facing dogs (28, 29), for forcing the dogs tightly against the well walls.

Also, in the above basic method, the second step may be expanded into the following two steps, (1) generating a high pressure fluid in the bridge plug, and (2) opening by rupturing an elastic means or bladder (21) with the high pressure fluid for releasing the expandable means (22) for simultaneously extending both sets of dogs for engaging the well walls at the desired depth in the well.

An additional step that may be added to the above basic method comprises, (1) opening a fluid exit port (16) in the body just above a folded basket means (18) on the body by opening or rupturing an elastic means (17) over the port for ejecting high pressure fluid from the port, and (2) unfolding the basket means against the well walls by ejecting a higher pressure fluid thereinto for forcing the basket open.

A more detailed method may comprise the method immediately above in with the first step thereof expanded to, (1) opening the port in the bridge plug by rupturing an elastic means (17) thereover by applying a higher pressure to the port for releasing the high pressure fluid into the basket means for unfolding the basket means against the well walls for subsequently being filled with cement, or the like.

THE PREFERRED EMBODIMENT FOR PRACTICING THE INVENTION

The above methods for plugging a well may be performed by other mechanisms than that disclosed in the FIGURES. The mechanism disclosed herein may be operated by other methods than those disclosed, as by hand. Also the disclosed mechanism can be used to practice another and materially different method. However, while various devices may be utilized for carrying out or practicing the inventive methods, the preferred system for performing the method is disclosed in FIGS. 1 and 2.

A "bridge plug" is by definition, a down-hole tool, composed primarily of slips, plug mandrel, and a sealing cement which may be rubber, cement, etc., which is run in and set in casing to isolate a lower zone while testing an upper section or to aid in cementing the well by holding the cement until it has hardened in place to plug the well.

FIG. 1 illustrates the new bridge plug 10 in folded position wherein a shear pin 11 retains a female cylindrical connecting portion 12 of the bridge plug connected to a male smaller cyclindrical and telescopic portion 13 of the lower end of a well drill string tubing 14 for running or lowering the bridge plug into the well to the desired depth. The bridge plug 10, FIG. 1, has a passage 15 from the tubing 14 down past a fluid exit 16 having closure 17 for opening a basket 18 therearound and continues down to a piston plug 19 tightly fitting in the top of an elongated cylindrical portion 20 of the passage 15. The closure 17 for sealing closed exit 16 is an expandable opening means, such as but not limited to a rupturable bladder, an important feature of the invention, as explained hereinafter. The cylindrical channel portion 20 has elastic sealing pads 19*a* secured in the surface thereof for frictionably retaining the piston plug 19 in the top of the cylinder until forced down by liquid force. The cylinder 20 is filled with a liquid below piston plug 19, as with salt water, and the passage 15 continues down below the cylinder to end at a second opening covered with an opening trigger means, such as but not limited to, a rupturable bladder 21.

Rupturable bladder or trigger means 21, FIG. 1, holds an expandable coil spring 22 coiled around the tubular lower end 23 of the bridge plug 10 and in a compressed state between two collars 24 and 25. Each of the latter collars 24, 25, which are also slideable on the lower tubular end of the bridge plug are pivotally linked with a plurality or groups of links, as pivotal links 26*a*, 26*b*, and 27*a*, 27*b*, respectively, to a plurality or group of slips or dogs, as dogs 28*a*, 28*b*, and 29*a*, 29*b*.

Slips or dogs are usually wedge shaped elongated pieces of metal with teeth or other gripping elements, used to prevent a pipe or bridge plug in this case, from slipping down into the hole or for otherwise holding the bridge plug in place.

Figure 2:
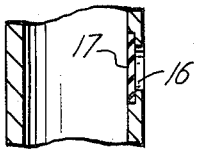
FIG. 2 is a detailed view of the rupturable bladder for permitting the high pressure fluid to open the basket.
Figure 3:
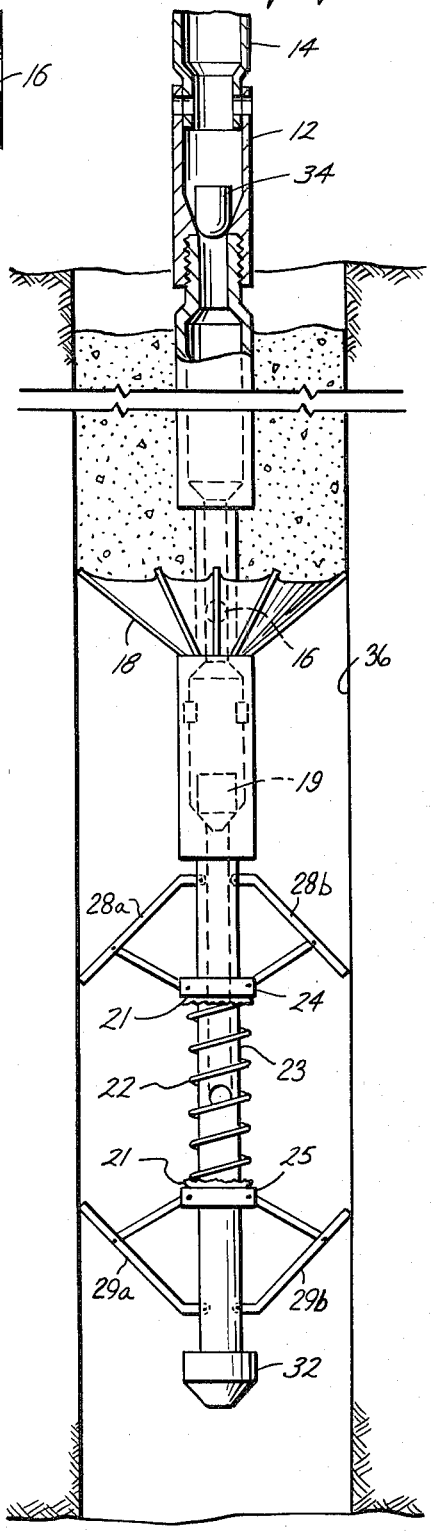
FIG. 3 is the bridge plug of FIG. 1 in open position at the desired depth in the well.

With the upper dogs 28*a*, 28*b*, FIGS. 1 and 2, pivotally connected with pivot pins 30*a*, 30*b*, respectively, FIG. 2, to the tubular lower end, and lower dogs 29*a*, 29*b*, FIGS. 1 and 2, similarly pivotally connected, expanding movement of the coil spring 22 moves the collars away from each other, as from the retracted or folded position of FIG. 1 to the extended position of FIG. 2.

A fishing neck 31 is formed at the top of the bridge plug for ease of hooking on and retrieving the bridge plug if it should accidentally become separated from the well tubing, or the like.

On the lower tip of the lower end 23 of the bridge plug is a conventional weight and shock absorber 32 for use to assure that the bridge plug does not hang up on a small obstruction in the well, and in the case of an unusually hard contact with the bottom or side protrudance is made, integrity of the bridge plug is preserved.

Briefly in operation, when a plugback workover using only one trip down into the well is desired, the disclosed bridge plug 10, FIG. 1, is secured as by being screwed onto the bottom of the drill string tubing 14 and then lowered into the well to the desired depth when in the folded condition of FIG. 1 wherein the slips 28–29 and basket 18 are folded up and the lower plug 19 is held in place by the elastic sealing pads 19*a*. At this point, a liquid as salt water is pumped down the drill tube through the passage 15 to the piston plug 19. Then as the pressure builds up, piston 19 is forced down and raising the liquid pressure in the bladder 21 at the bottom of the passage 15 until it ruptures. Thus, the triggering force required to rupture the bladder can be accurately controlled by the particular construction of the bladder.

Upon rupture of bladder or trigger means 21, the compressed coil spring 22 is released suddenly and quickly to push the collars 24 and 25 away from each other to suddenly actuate the folded dogs 28*a*, 28*b*, 29*a*, and 29*b* to fully extended position up hard against the walls of the well. Thus dogs 28*a* and 28*b* resist further downward movement of the bridge plug 10 and dogs 29*a* and 29*b* resist upward movement of the bridge plug. Piston plug 19 comes to rest against a conical wall portion 33 of the passage 15 for sealing the lower end of the passage as illustrated in FIG. 2. Then additional pumping of salt water down the passage 15 bursts or ruptures bladder 17 covering opening 16 for opening the basket 18. This second bladder is formed to rupture at a precise amount of pressure higher than the rupture pressure of the lower and first bladder 21. Thus these two bladders can easily be formed to rupture at precisely different pressures in order to maintain the proper sequence without overloading the pump or source of fluid pressure. Immediately behind the slug of salt water to open the basket is introduced cement down the passage 15 to plug 19 to fill the basket and the space around the bridge plug up to the fish neck 31. Then, a wiper plug 34 is forced down the well tubing by fluid pressure generated by a suitable pump at the surface for cleaning the tubing as it slides tightly therein downwardly into the bridge plug passage 15. There, the wiper plug shears the connecting shear pin 11 to release the bridge plug 10 from the well tubing 14. This release may be detected or signalled by a momentary rise in pump pressure as the plug comes to rest in sealing contact with the conical wall portion 35, FIG. 1, in the upper end of passage 15. The tubing is then raised out of the polished bore.

With the precisely formed bladders which rupture in precise sequence with a minimum of pump pressure, a bridge plug is formed which requires only one trip to do the job with little chance of sticking during plugback, and particularly, a low cost operation is assured.

Another advantageous result is a homogeneous cement job that will not move under high pressure and thus is always seated properly.

Further, a cement bridge plug is more easily drilled than a cast iron bridge plug and thus the casing is not damaged by the full bore mills which are required to drill the slips of a cast iron bridge plug.

Accordingly, it will be seen that the disclosed methods for plugging a well and the disclosed bridge plug will operate in a manner which meets each of the objects set forth hereinbefore.

While only a few methods of the invention and one mechanism for carrying out the methods have been disclosed, it will be evident that various other methods and modifications are possible in the arrangement and construction of the disclosed methods and bridge plug without departing from the scope of the invention and it is accordingly desired to comprehend within the purview of this invention such modifications as may be considered to fall within the scope of the appended claims.

I claim:

1. A method for plugging a well comprising, (a) extending two sets of dogs on a bridge plug for engaging the sides of the well by releasing an expandable means, (b) generating a high pressure fluid in the bridge plug, and (c) opening an elastic means with the high pressure fluid for releasing the expandable means for simultaneously extending both sets of dogs for engaging the well walls at the desired depth in the well.

2. A method as recited in claim 1 comprising the additional steps of, (a) opening a port in the body just above a folded basket means on the body by opening an elastic means over the port for ejecting high pressure fluid from the port, and (b) unfolding the basket means against the well walls by ejecting a higher pressure fluid thereinto for forcing the basket open.

3. A method as recited in claim 2 wherein the first step comprises further, (a) opening the port in the bridge plug by rupturing an elastic means thereover by applying a higher pressure to the port for releasing the high pressure fluid in the basket means for unfolding the basket means against the well walls for subsequently being filled with cement, or the like.

4. A bridge plug having an elongated body for being connected to the bottom of a well tubing and having two sets of dogs mounted on the body for movement between a retracted position flush on the body and an extended position engaging the walls of the well comprising, (a) expandable means for extending both sets of dogs when released, and (b) trigger means for releasing said expandable means for engaging the dogs with the well walls for securing the bridge plug at the desired depth in the well, comprising (c) piston means for forcing a fluid into said trigger means for increasing the fluid pressure therein, and (d) rupturable elastic means responsive to said high fluid pressure for releasing said expandable means for extending both sets of dogs for engaging the well walls at the desired depth.

5. A bridge plug as recited in claim 4 comprising further, (a) foldable basket means on the bridge plug elongated body for being opened by ejection of high pressure fluid from a port in the body, and (b) actuating means on said port for opening of the port for opening said foldable basket against the well walls.

6. A bridge plug as recited in claim 5 wherein, (a) said actuating means being rupturable elastic means responsive to a higher pressure in the body fluid for rupturing and releasing the high pressure fluid in the foldable basket for opening said basket against the well walls for subsequently being filled with cement, or the like.

* * * * *